US005749184A

United States Patent [19]

McKann

[11] Patent Number: 5,749,184

[45] Date of Patent: May 12, 1998

[54] LIGHT FRAME SYSTEM WITH FASTENER CLIPS

[75] Inventor: H. Smith McKann, Fredericksburg, Va.

[73] Assignee: General Products Company, Inc., Fredericksburg, Va.

[21] Appl. No.: 747,897

[22] Filed: Nov. 13, 1996

Related U.S. Application Data

[63] Continuation-in-part of Ser. No. 584,550, Jan. 11, 1996, Pat. No. 5,644,874, which is a continuation-in-part of Ser. No. 415,460, Apr. 3, 1995, abandoned.

[51] Int. Cl.[6] ..... E06B 1/04; E06B 3/58

[52] U.S. Cl. ..... 52/204.1; 52/212; 52/204.591; 52/455; 52/656.6; 49/501; 40/780

[58] Field of Search ..... 52/204.1, 204.5, 52/204.591, 204.595, 204.597, 207, 208, 455, 656.5, 656.6, 212–214; 49/501; 40/780, 782

[56] References Cited

U.S. PATENT DOCUMENTS

| | | | |
|---|---|---|---|
| 1,171,444 | 2/1916 | Larson . | |
| 1,227,066 | 5/1917 | Ohe . | |
| 1,323,753 | 12/1919 | Gogay . | |
| 1,850,180 | 3/1932 | Pinney | 40/780 |
| 2,009,142 | 7/1935 | Marsh | 52/202 |
| 2,654,920 | 10/1953 | Kessler | 52/402 |
| 2,996,767 | 8/1961 | Kobil | 52/214 |
| 3,004,641 | 10/1961 | Johnson . | |
| 3,034,612 | 5/1962 | Jourdan | 40/782 |
| 3,263,357 | 8/1966 | Carleton | 40/780 |
| 3,305,998 | 2/1967 | Deisenroth | 52/656 |
| 3,376,670 | 4/1968 | Jones | 49/501 |
| 3,760,543 | 9/1973 | McAllister | 52/397 |
| 3,788,019 | 1/1974 | Kiselewski | 52/212 |
| 3,793,788 | 2/1974 | Collins | 52/214 X |
| 3,949,526 | 4/1976 | Sherlock et al. | 49/501 |
| 3,969,857 | 7/1976 | Stark | 52/208 |
| 4,024,691 | 5/1977 | Hansen | 52/656 |
| 4,074,483 | 2/1978 | Vickstrom | 52/202 |
| 4,259,818 | 4/1981 | Stark | 52/212 |
| 4,413,397 | 11/1983 | McKann | 29/416 |
| 4,430,836 | 2/1984 | McKann | 52/455 |
| 4,466,220 | 8/1984 | Lewkowitz | 52/127.6 |
| 4,550,542 | 11/1985 | La See | 52/656.6 |
| 4,920,718 | 5/1990 | Artwick et al. | 52/204.591 |
| 4,924,649 | 5/1990 | Taylor | 52/656 |
| 4,947,597 | 8/1990 | Simpson | 52/204.591 |
| 5,105,597 | 4/1992 | Wilkening | 52/455 |
| 5,123,211 | 6/1992 | Schlicht | 52/202 |

*Primary Examiner*—Carl D. Friedman
*Assistant Examiner*—Winnie S. Yip
*Attorney, Agent, or Firm*—Roylance, Abrams, Berdo & Goodman, L.L.P.

[57] ABSTRACT

A frame assembly for a door light is formed with inner and outer half-frames sandwiching a translucent panel. The half-frames have a plurality of side members defining a closed polygon. Each side member includes, in cross-section, a flat portion for supporting the frame in an opening in a support, a face portion extending from the flat portion towards the center of the polygon, a third portion extending inwardly from the face portion toward the other half-frame and to a position adjacent the translucent panel, and a fourth portion extending from the third portion parallel to the face portion and away from the center of the polygon. Fasteners extend through bores in the inner half-frame and engage clips slidably adjustable in the outer half-frame to couple and secure the half-frames in the support opening. Each clip has a base with an opening receiving a fastener, and legs with flanges engaging the fourth portion and a lip on the flat portion of the outer half-frame.

11 Claims, 2 Drawing Sheets

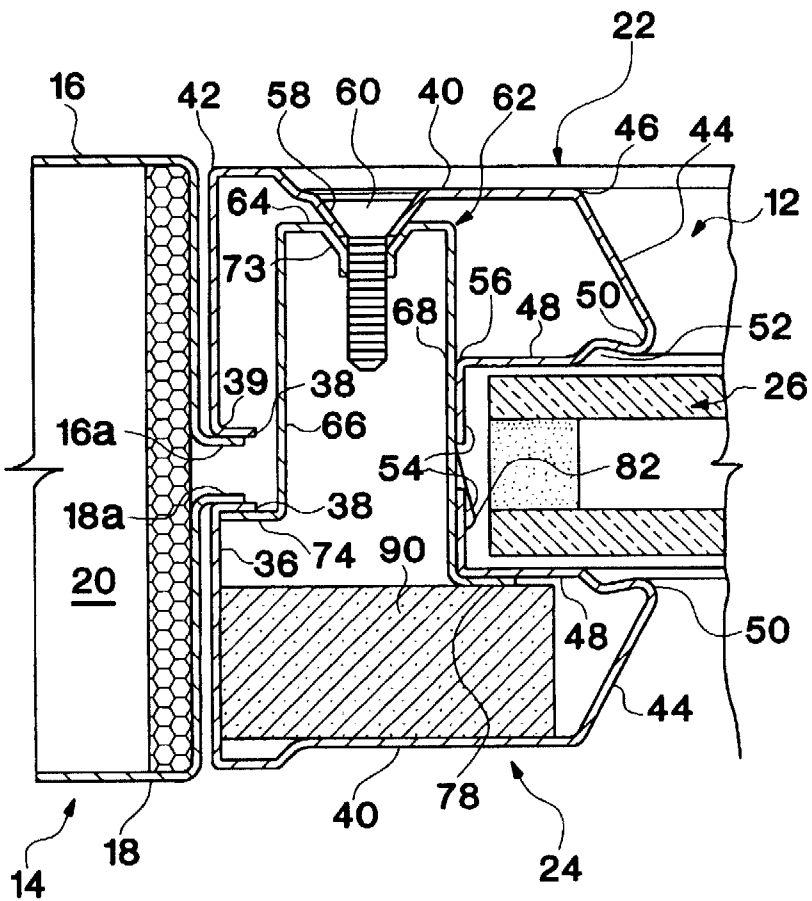
FIG. 2
FIG. 1
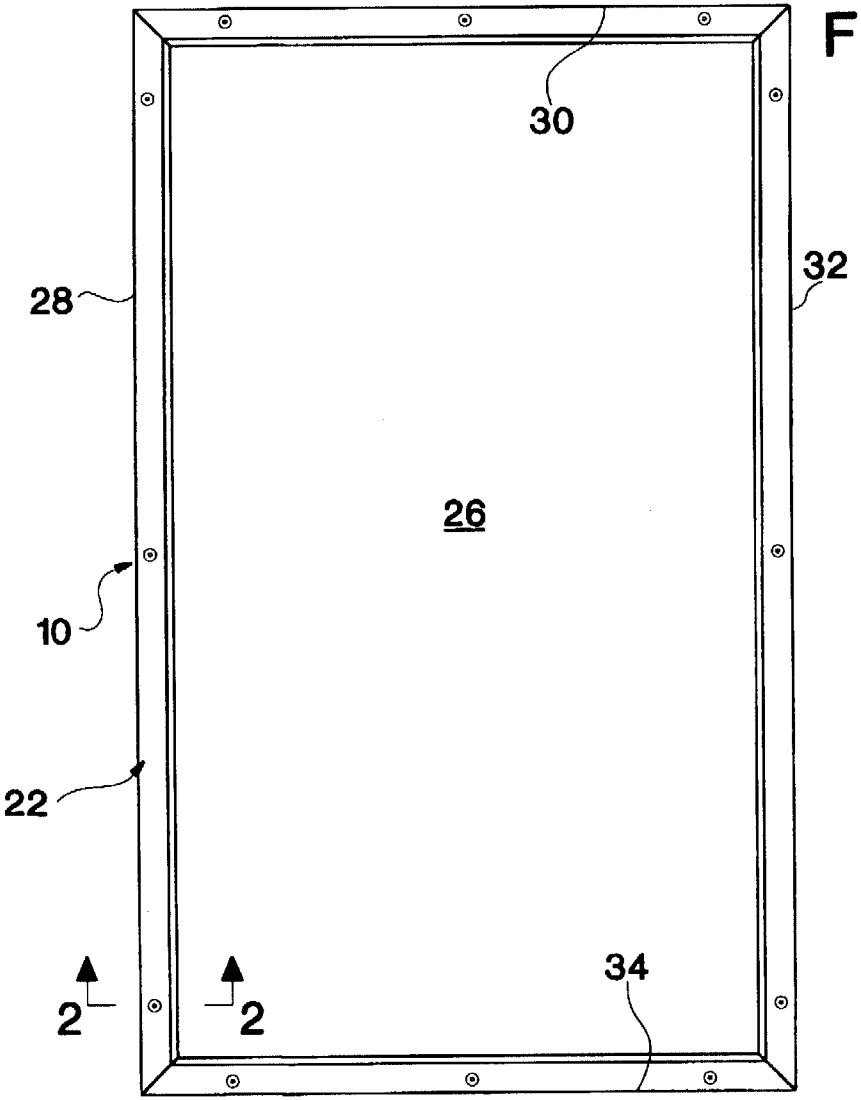

LIGHT FRAME SYSTEM WITH FASTENER CLIPS

CROSS-REFERENCE TO RELATED APPLICATIONS

This application is a continuation-in-part of U.S. patent application Ser. No. 08/584,550 to H. Smith McKann, filed Jan. 11, 1996, now U.S. Pat. No. 5,644,874, which is a continuation-in-part of U.S. patent application Ser. No. 08/415,460 to H. Smith McKann, filed Apr. 3, 1995, now abandoned. The subject matter of each application is hereby incorporated by reference.

FIELD OF THE INVENTION

The present invention relates to a frame assembly for a door light. The frame is formed from inner and outer half-frames which secure a translucent panel therebetween for mounting in a door opening. The half-frames are coupled and secured in a door by fasteners extending through bores in the inner half-frame and clips slidably mounted in the outer half-frame.

BACKGROUND OF THE INVENTION

Doors used as replacements or for new construction are conventionally produced of sheet metal. These doors, particularly when used as outside entrances, as opposed to interior doors, preferably have one or more window sections. These window sections are known as lights and are formed in the door. Numerous frame assemblies have been proposed for use as door light frames.

Door light frames conventionally comprise inner and outer half-frames which sandwich a translucent panel therebetween and support the panel within an opening formed in the door. Each half-frame is formed separately and has a plurality of side members defining a close polygon. Usually, the side members of each frame are separately formed and then attached together by welding, for example, U.S. Pat. No. 3,004,641 to Johnson, or by corner attaching members, for example, U.S. Pat. No. 4,024,691 to Hansen et al. and U.S. Pat. No. 3,949,526 to Sherlock et al. These conventional methods of forming half-frames are difficult, time-consuming and expensive. Additionally, these side frames are relatively weak at their side member connections. When the side members are welded together to form the half-frames, such welding prevents the use of pre-painted metal strips for forming the frames and require finishing operations after the frame is formed.

Another disadvantage of conventional door systems involves the use of differently formed members for the inner and outer half-frames. Manufacturing and assembly costs are significantly increased by using two differently formed half-frames to produce the frame assembly.

Numerous fastener systems have been used to secure the half-frames together and to the door. Arrangements including threaded fasteners are disclosed in U.S. Pat. Nos. 4,430,836 and 4,413,397 to McKann, the subject matter of each patent being incorporated herein by reference. However, these arrangements require the relatively precise relative positioning of the fastener parts or of the holes in the half-frames for the fastener parts. The fastener means are not readily adjustable to permit realignment of the fastener mechanism during assembly. Further, these mechanisms use the fastener mechanism for supporting the frame, which supporting complicates assembly.

Conventional door light frame systems often are difficult to adequately insulate. Thermal insulation can be a significant problem, particularly for metal frames which may readily conduct heat between the inner and outer half-frames.

Some conventional door light frame systems are disadvantageous in that the fastener means are exposed on the outer half-frame. Such exposure requires special treatment to obscure that fastener end, thereby complicating assembly.

BRIEF DESCRIPTION OF THE INVENTION

An object of the present invention is to provide a frame assembly for a translucent panel which is simple and economical to manufacture and install, and which is of rugged construction and has good insulation characteristics.

A further object of the present invention is to provide a frame assembly for a translucent panel which can be easily and simply secured within a door opening.

Another object of the present invention is to provide a method of simply and economically manufacturing a frame assembly for a translucent panel which is attractive and secure.

The foregoing objects are basically obtained by a frame assembly for a door light comprising inner and outer half-frames sandwiching a translucent panel therebetween. Each of the half-frames have a plurality of side members defining a closed polygon. Each side member includes, in cross-section, a flat portion for supporting the frame in an opening in a support, a face portion extending in a generally perpendicular direction from the flat portion toward the center of the polygon, a third portion extending generally inwardly from the face portion toward the other half-frame to a position adjacent the translucent panel, and a fourth portion extending from the third portion in a direction generally parallel to the face portion and away from the polygon center. Lips extending from the flat portion are spaced from the face portions of the side members of the outer half-frame, and extend generally toward the center of the polygon. Bores extend through the face portions of the inner half-frame. Clips are attached to the outer half-frame, and are adjustably slidable along the respective side member. Each clip includes a base with an opening, a first leg extending from the base and having a first flange extending angularly therefrom and engaging the respective lip, and a second leg extending from the base and adjacent a peripheral edge of the translucent panel and having a second flange extending angularly therefrom and engaging the respective fourth portion of the outer half-frame. Elongated fasteners extend through the bores and openings, and engage the clips to couple and secure the half-frames in the support opening.

By forming the frame assembly in this manner, the clips are formed and shaped to support the translucent panel. Additionally, the clips reinforce the half-frames at the fasteners to prevent collapsing of the half-frames when the fasteners are tightened.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure:

FIG. 1 is a front elevational view of a frame assembly with a translucent panel mounted therein according to the present invention;

FIG. 2 is a partial bottom plan view in section taken along line 2—2 of FIG. 1;

DETAILED DESCRIPTION OF THE INVENTION

Figure 3:
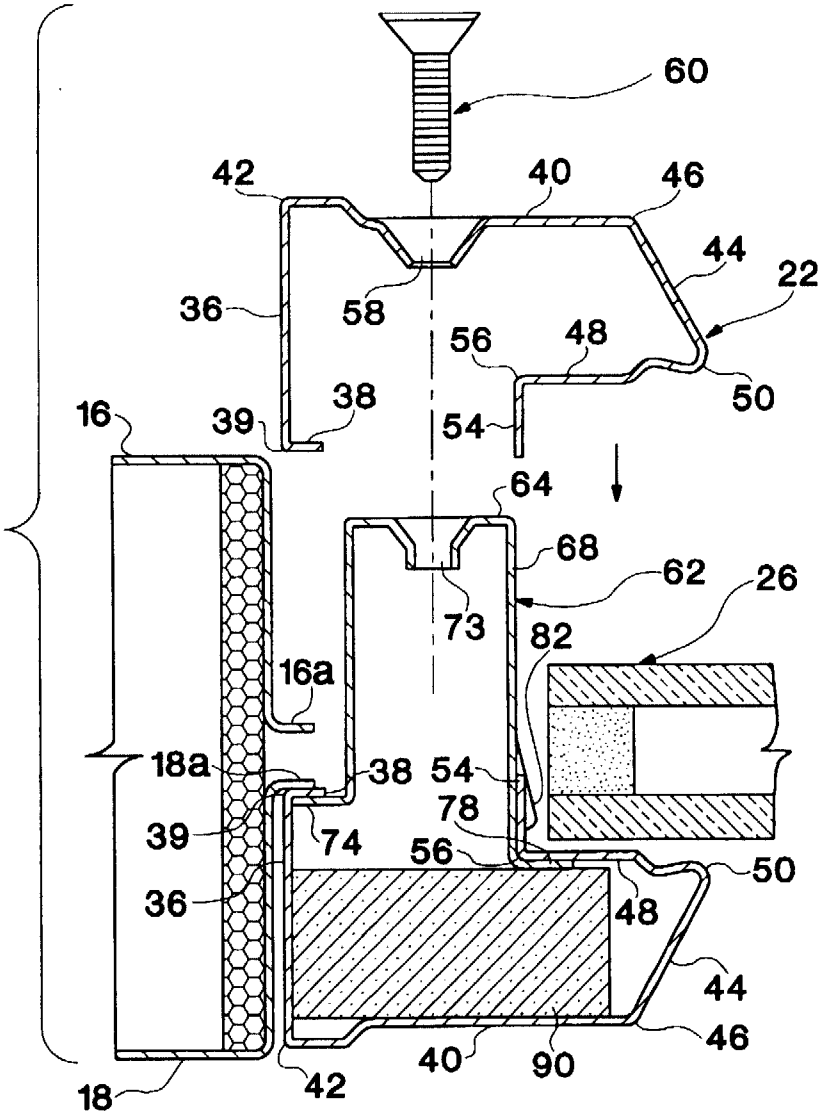
FIG. 3 is a partial, exploded bottom plan view of the frame assembly of FIG. 2.

Referring initially to FIGS. 1 and 2, a frame assembly 10 is mounted in an opening 12 of a door 14 or other support. The mounting of the frame in the door or other support is also disclosed in U.S. Pat. No. 4,430,836 to McKann.

Conventional door 14 comprises an inner sheet 16 and an outer sheet 18 forming the major surfaces of the door and having decorative relief portions normally formed therein. Sheets are connected by transverse edges with a void between the sheets and with an insulating foam material 20. Since the door construction is conventional, the door is not described further in detail.

Frame assembly 10 comprises an inner half-frame 22 and an outer half-frame 24. The half-frames sandwich a translucent panel 26 between them for supporting the translucent panel in door opening 12. Translucent panel 26 is conventional, and thus, is not described further in detail.

Each half-frame is separately formed but substantially similar or identical in construction of sheet material, preferably sheet metal (e.g., steel). Thus, a single half-frame can be formed for use as an inner or outer half-frame. Each half-frame includes a plurality of substantially similar side members which define a closed polygon. Any desired polygonal shape can be provided. Additionally, the side members can be curvaleaner.

In the illustrated embodiment, each half-frame defines a polygonal shape having four side members 28, 30, 32, and 34. The four side members have substantially identical cross-sectional configurations. In view of the substantially identical nature of the cross-sectional configuration of each side member of each half-frame, only one will be described in detail.

In cross-section, each side member comprises a generally planar flat first portion 36 which engages the surfaces of the door defining opening 12. The free or inner edge of flat portion 36 is bent at a substantially 90 degree angle along a fold or bend line 39 to define a lip 38. Lip 38 engages radially bent portions 16*a* and 18*a* of door sheets 16 and 18, respectively.

On the outer edge of flat portion 36, a face or second portion 40 extends along a bend or fold line 42 substantially perpendicularly from the flat portion toward the center of the polygon defined by the frame assembly. A third portion 44 extends in an inward direction at a generally obtuse angle from face portion 40 along fold or bend line 46. The third portion extends from the face portion for a distance to a position adjacent translucent panel 26. A fourth portion 48 extends from the third portion in a direction generally parallel to face portion 40 along fold or bend line 50 and in a direction from the frame polygon center.

Adjacent fold line 50, fourth portion 48 comprises a recess 52. Recess 52 provides a space of sufficient size and shape to permit caulking to be located between adjacent frame edge and the translucent panel. Since the recess is undercut, i.e., decreases in transverse dimension in a direction toward the center of the frame polygon, the caulking is locked into the frame. Additionally, this space can provide an attachment facilitating insertion of clips for securing a decorative grill to the frame assembly and over the translucent panel.

A fifth portion 54 extends inwardly from fourth portion 48 along fold or bend line 56. The fourth and fifth portions are substantially perpendicular to one another such that fourth portion can overlie a face surface of the translucent panel, while the fifth portion engages a peripheral edge of the translucent panel. The engagement of the translucent panel by the fourth and fifth portions provides a positive connection between the frame assembly and the translucent panel to securely and precisely locate the translucent panel in the desired position. Additionally, the fourth and fifth portions provide a definitive seat for the translucent panel within the frame assembly, independent of the fasteners, to facilitate mounting of the translucent panel in the frame assembly.

Inner half-frame 22 has a plurality of countersunk bores 58 formed in its face portions 40. The bores 58 receive externally threaded fastener screws 60 for securing the two half-frames together within door opening 12. As best illustrated in FIGS. 2 and 3, fastener screws 60 (e.g., flathead sheet metal screws) engage an U-shaped clip 62 adjustably mounted in outer half-frame 24.

Figure 6:
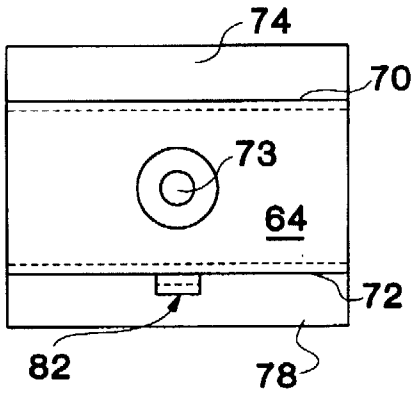
FIG. 6 is a top plan view of the clip of FIG. 1.
Figure 4:
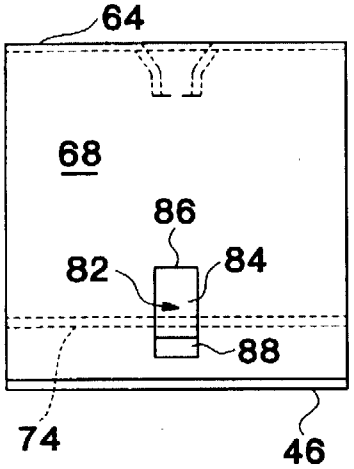
FIG. 4 is a front elevational view of a clip of the frame assembly of FIG. 1.
Figure 5:
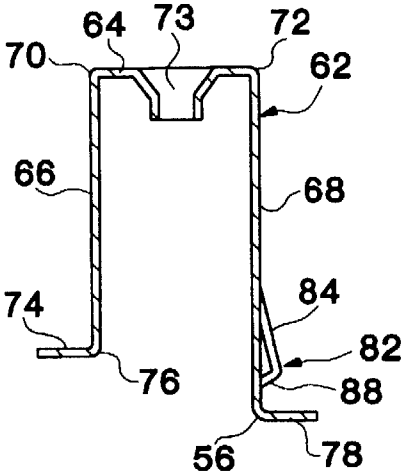
FIG. 5 is a side elevational view in cross-section of the clip of FIG. 4.

The generally U-shaped clip member, as illustrated in FIGS. 4–6, comprises a substantially planar base 64 and first and second substantially planar legs 66 and 68 extending substantially perpendicularly from opposite edges of base 64 along fold lines 70 and 72, respectively. The clip is formed of a single piece of resilient material, e.g., sheet steel. Base 64 has a countersunk opening 73 with an internally threaded portion for engaging the externally threaded portion of screw 60. First leg 66 has a planar first flange 74 extending substantially perpendicularly from an end of leg 66 remote from base 64 along fold line 76. Second leg 68 is somewhat longer than first leg 66, and has a planar second flange 78 extending substantially perpendicularly from an end of leg 68 remote from base 64 along a fold line 80.

Adjacent second flange 78, second leg 68 has a resilient projection 82. Resilient projection 82 is formed from and as a unitary one piece part of the remainder of clip 62, and comprises a first section 84 hinged to leg 68 along fold line 86 and a second section 88 extending at an angle to the first section located at the free end of the first section. First section 84 extends at an acute angle relative second leg 68.

In its assembled position, second leg 68 is substantially parallel to and overlies fifth portion 54 to reinforce the fifth portion. Second flange 78, adjacent the free edge of second leg 68, engages an inside surface of fourth portion 48 and an insulation block 90 between the face and fourth portions of outer half-frame 24. First flange 74, adjacent to free edge of first leg 66, engages an inside surface of lip 38 of outer half-frame 24. Resilient projection 82 extends through the outer half-frame fifth portion to engage and resiliently bias the peripherial edge of translucent panel 26. When clip 62 is properly located within outer half-frame 24, and the inner and outer half-frames are located adjacent each other, countersunk bore 58 is coaxially aligned with opening 73 to engage threaded fastener 60.

When the half-frames are assembled in position relative to one another, each threaded fastener 60 is passed through a bore 58 to engage threaded opening 72 in the respective clip member mounted in the outer frame member. Since clip member 62 merely abuts fourth portion 48 and lip 38 of the outer half-frame, it can be adjusted by sliding along the length of each outer frame side member to its aligned position. When the screw is tightened, the clip will frictionally engage the fourth portion and the lip to positively and securely retain the clip member and thereby the half-frame members in their proper position.

Legs 66 and 68 extend into inner half-frame 22 such that base 64 is adjacent face portion 40 of the inner half-frame and end segments of that face portion defining bores 58 are received within and engage the countersunk segments of openings 62 in clip base 64. The heads of screws 60 engage and trap such half-frame end segments with the outer half-frame countersunk segments. This clip structure, when assembled in the half-frames, prevents collapsing of the half-frames when fastener 60 is tightened.

Bores 58 need only be formed in the inner half-frame. No bores are necessary in the outer half-frame. Thus, additional finishing of the outer frame is not necessary. Moreover, a more secure structure is provided since there is no access to these screws from the outer surface of the door.

While a particular embodiment has been chosen to illustrate the invention, it will be understood by those skilled in the art that various changes and modifications can be made therein without departing from the scope of the invention as defined in the appended claims.

What is claimed is:

1. A frame assembly for a door light, comprising inner and outer half-frames sandwiching a translucent panel therebetween, each of said half-frames having a plurality of side members defining a closed polygon;

each of said side members including, in cross-section, a flat portion for supporting the frame in an opening in a support, a face portion extending in a generally perpendicular direction from said flat portion toward a center of said polygon, a third portion extending generally inwardly from said face portion toward the other half-frame to a position adjacent said translucent panel, and a fourth portion extending from said third portion in a direction generally parallel to said face portion and away from the center of said polygon;

lips extending from said first portions and spaced from said face portions of said side members of said outer half-frame and extending generally toward the center of the polygon;

bores extending through said face portions of said inner half-frame;

clips attached to said outer half-frame, each clip being adjustably slidable along the respective side member, each said clip including a base with an opening, a first leg extending from said base and having first flange extending angularly therefrom and engaging the respective lip, and a second leg extending from said base and adjacent a peripheral edge of said translucent panel and having a second flange extending angularly therefrom and engaging the respective fourth portion of said outer half-frame; and elongated fasteners extending through said bores and said openings and engaging said clips to couple and secure said half-frames in the support opening.

2. A frame assembly according to claim 1 wherein said first and second legs are substantially parallel and extend substantially perpendicularly from said base.

3. A frame assembly according to claim 1 wherein a fifth portion extends inwardly from said fourth portion of each said side member of each said half-frame toward the other half-frame and about the peripheral edge of the translucent panel;

said second legs of said clips engage and overlies said fifth portions.

4. A frame assembly according to claim 1 wherein said first and second legs are substantially planar.

5. A frame assembly according to claim 1 wherein said second leg of each said clip comprise a resilient projection extending and biased toward said translucent panel.

6. A frame assembly according to claim 1 wherein each said clip extends from said outer half-frame into an interior portion of said inner half-frame, with said base being adjacent and engaging said face portion of said inner half-frame.

7. A frame assembly according to claim 1 wherein each of said half-frames are formed from sheet metal.

8. A frame assembly according to claim 1 wherein each of said half-frames are formed of a unitary and continuous blank of sheet metal.

9. A frame assembly according to claim 1 wherein said inner and outer half-frames are separately and similarly formed of sheet material and have substantially similar side members.

10. A frame assembly according to claim 1 wherein said elongated fasteners and said openings in said clips are threaded.

11. A frame assembly according to claim 1 wherein insulating blocks are mounted in said outer half-frame, engage said face portions of said outer half-frame and trap said second flanges of said clips with said fourth portions of said outer half-frame.

* * * * *